US005817220A

United States Patent [19]

Chen

[11] Patent Number: 5,817,220

[45] Date of Patent: Oct. 6, 1998

[54] ELECTROPLATING APPARATUS

[75] Inventor: Eugene Chen, Taipei, Taiwan

[73] Assignee: General Semiconductor, Inc., Melville, N.Y.

[21] Appl. No.: 541,605

[22] Filed: Oct. 10, 1995

Related U.S. Application Data

[63] Continuation of Ser. No. 282,914, Jul. 29, 1994, abandoned.

[51] Int. Cl.[6] ..... C25D 17/20

[52] U.S. Cl. ..... 204/213; 204/222; 204/287; 204/279; 204/297 R; 204/297 W

[58] Field of Search ..... 204/213, 214, 204/279, 285, 287, 297 R, 297 W, 222

[56] References Cited

U.S. PATENT DOCUMENTS

| | | | |
|---|---|---|---|
| 2,766,201 | 10/1956 | Luther | 204/213 |
| 2,841,547 | 7/1958 | Kotz et al. | 204/287 X |
| 3,090,823 | 5/1963 | Roach | 204/297 W X |
| 3,340,174 | 9/1967 | Buynak | 204/213 |
| 3,782,144 | 1/1974 | Gonyo et al. | 204/287 X |
| 4,946,572 | 8/1990 | Hickey | 204/213 |

*Primary Examiner*—Donald R. Valentine

[57] ABSTRACT

An electroplating apparatus comprises a rotating cage with a shaft therethrough and connecting seats, each of the connecting seats being tangent to the shaft, and a plurality of containers which are respectively received in each of the connecting seats. Each of the containers comprises a thin box and a screen provided thereon as a cap, and each box includes a plurality of spaced apart baffle plates sub-dividing the box into a plurality of compartments. Each of the compartments has two side walls which are respectively provided with a plurality of thorns, so as to form two thorny walls. All electronic parts are disposed in parallel between the thorny walls to avoid entanglements and damage of parts being electroplated. Also, the thorns provide extended area electrode contacts for the parts, resulting in more uniform parts plating.

17 Claims, 4 Drawing Sheets

ELECTROPLATING APPARATUS

This is a continuation of application Ser. No. 08/282,914 filed on Jul. 29, 1994, now abandoned.

BACKGROUND OF THE INVENTION

1. Field of the Invention

The present invention relates to electroplating, and particularly to a parts container for providing more uniform electroplating and reduction of damage to parts being electroplated.

2. Prior Art

Referring to FIG. 1, in which a conventional apparatus for electronic parts used in an electroplating process is shown, the conventional apparatus is provided with a plurality of tanks "A" and a metal piece B serving as an anode, such as tin, lead, copper, silver, and the like. Electronic parts are firstly put into a rolling barrel "C" and then the rolling barrel "C" is disposed in the electroplating apparatus as shown in FIG. 1. As shown in FIG. 2, an electronically conducting shaft "D" is provided at the center of the conventional rolling barrel "C". The substantially cylindrical wall of the rolling barrel "C" is composed of a number of covers "C1" in which a plurality of apertures are formed so that the electrolyte can flow through the rolling barrel. A large quantity of electronic parts are put in the barrel "C" so as to be electroplated. The rolling barrel "C" is rotatably connected to a cantilever "E" which is connected with an actuating rod "F" which is able to rotate and/or vertically translate the rolling barrel "C". In such an apparatus, since a large quantity of electronic parts are inevitably crowded in the rolling barrel "C", damage to the parts, e.g., bending of extending lead wires, frequently occurs. To overcome this problem, the electrically conducting shaft is provided with a plurality of electrically conducting rings "D" so as to avoid collisions between electronic parts. However, the bending problem still can not be solved effectively. This is because electronic parts are disorderly disposed in the rolling barrel "C" of the apparatus. Moreover, since the space inside the barrel "C" is relatively large, the chance of collisions between electronic parts is very high during the electroplating operation. As a result, the lead wires close to ends of an electronic part will suffer from being bent, and must be re-straightened prior to further use.

Apart from the above disadvantages, the conventional apparatus has the following disadvantages:

1. During electroplating, chains of touching and electrically connected together parts are periodically and randomly formed. All the electrically connected metal surface areas of the parts in the chain are electroplated, but the rate of plating tends to be greatest at the metal areas at the ends or tips of the chain most remote from the cathode. At such ends, the plating current density is the highest. Although chains of parts are constantly being made and broken on a random basis, the effect of such variable current density and variable plating rates is as follows.

With reference to FIG. 3, which is a schematic diagram of an electronic part, the reference numeral "3" is used to designate the body of the electronic part such as a resistor, capacitor and the like. Two lead wires 31 extend outwardly longitudinally along the body 3. Due to the nature of electroplating as it occurs in the prior art apparatus, each lead wire 31 is divided into a low current density zone (L.C.D.), a medium current density zone (M.C.D.) and a high current density (H.C.D.).

In general, the high current density zone (H.C.D.) is cut away after the electroplating process is finished, leaving only the low current density zone and/or a part of the medium current zone. Therefore, the electroplating quality of the low current density zone is an important factor influencing the quality of the electronic part.

In an experiment performed using the conventional apparatus, with the parameters of 8K electronic parts in one barrel, electroplating time of 10 minutes and current density of 25 amps per square foot, the result is shown as follows:

| | Plating Thickness Characteristics | Alloy Proportions |
|---|---|---|
| H.C.D. | Average: 552.5$\mu$ inches | 83.5% (Tin in a Tin-Lead Alloy) |
| | STD. Dev: 191.9$\mu$ inches | 0.9 |
| | MAX. Value: 882.6$\mu$ inches | 85.1% |
| | MIN. Value: 305.9$\mu$ inches | 82.3% |
| | Range: 576.7$\mu$ inches | 2.8 |
| L.C.D. | Average: 262.2$\mu$ inches | 86.6% |
| | STD. Dev: 135.0$\mu$ inches | 3.4 |
| | MAX. Value: 518.9$\mu$ inches | 94.3% |
| | MIN. Value: 32.6$\mu$ inches | 82.8% |
| | Range: 486.3$\mu$ inches | 11.5 |
| M.C.D. | Average: 410.0$\mu$ inches | 82.3% |
| | STD. Dev: 119.0$\mu$ inches | 1.0 |
| | MAX. Value: 579.2$\mu$ inches | 83.5% |
| | MIN. Value: 258.2$\mu$ inches | 88.9% |
| | Range: 321.0$\mu$ inches | 2.6 |

The above data indicate that the standard deviation (STD.DEV.) for the L.C.D. part of the leads (3.4) is the largest, which means the quality is poorest. The best plating quality and the greatest plating thickness are in the H.C.D. lead part, but this part is cut away. In view of this, there exists a need for achieving a more uniform electroplating.

2. After the electrolyte permeates through the cover C1 into the rolling barrel "C", the flow rate of the electrolyte is lowered, namely the exchange rate between the electrolyte inside the barrel "C" and the electrolyte outside the barrel is not high. As a result, the electroplating effect is not high.

3. After the electroplating process is finished, the cover "C1" must be removed and the rolling barrel is moved so as to pour the electronic parts out of the rolling barrel "C". Because of the large distances involved, further bending of the leads occurs.

SUMMARY OF THE INVENTION

The present invention provides a cage rotatable about a shaft and means for disposing a plurality of containers within the cage and oriented therein tangential to the cage shaft. The containers are partitioned into a plurality of compartments by baffle plates. Two end walls of each compartment are provided with a plurality of thorns for enhancing the probability of contact between parts being plated and the apparatus cathode electrode.

DESCRIPTION OF PREFERRED EMBODIMENTS OF THE INVENTION

Figure 1:
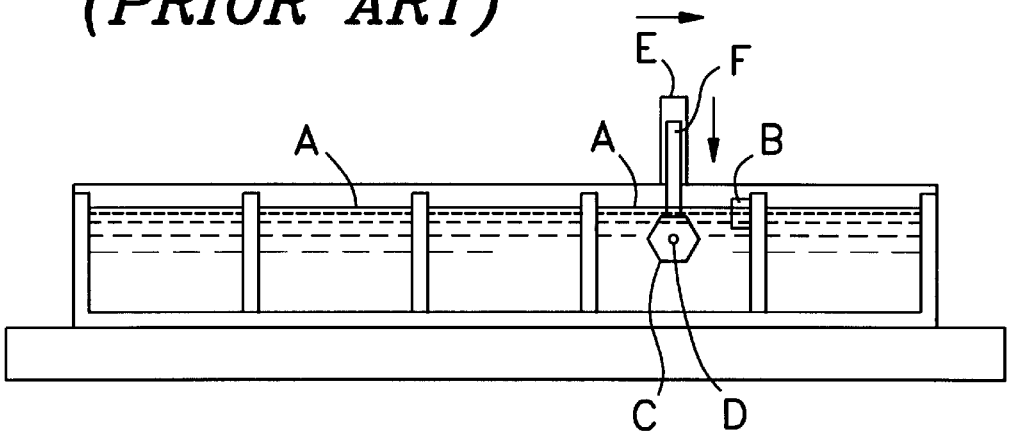
FIG. 1 (PRIOR ART)
FIG. 1 is a schematic diagram of a conventional electroplating tank.
Figure 2:
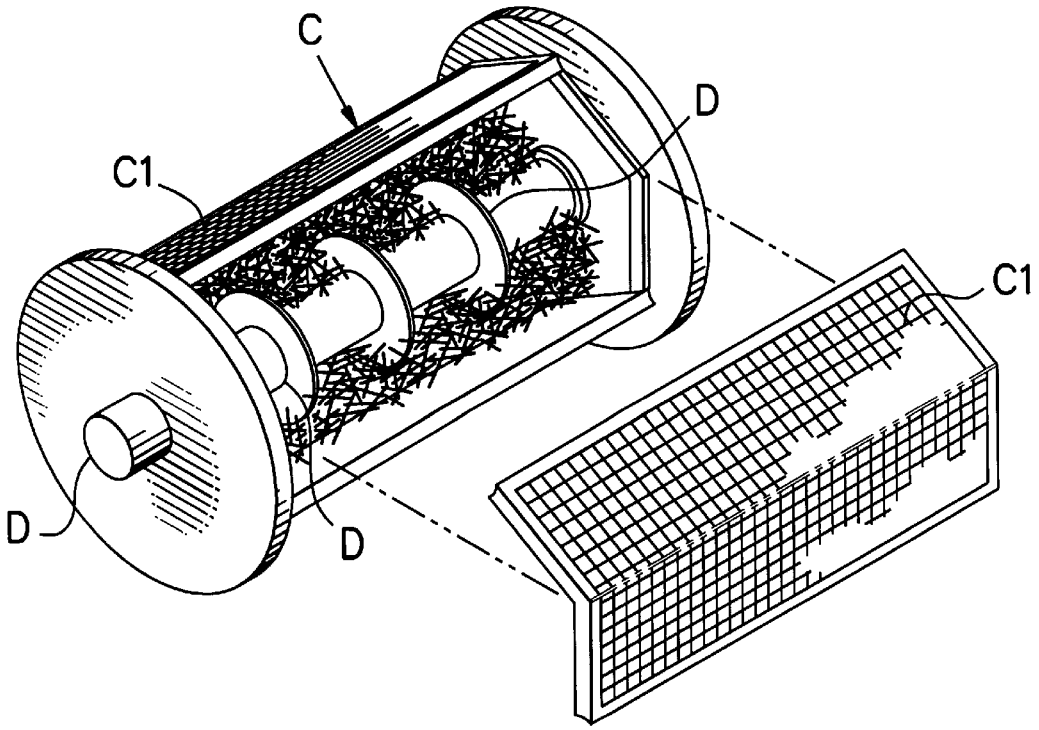
FIG. 2 (PRIOR ART)
FIG. 2 is a perspective view of a conventional rotating cage for electronic parts.
Figure 4:
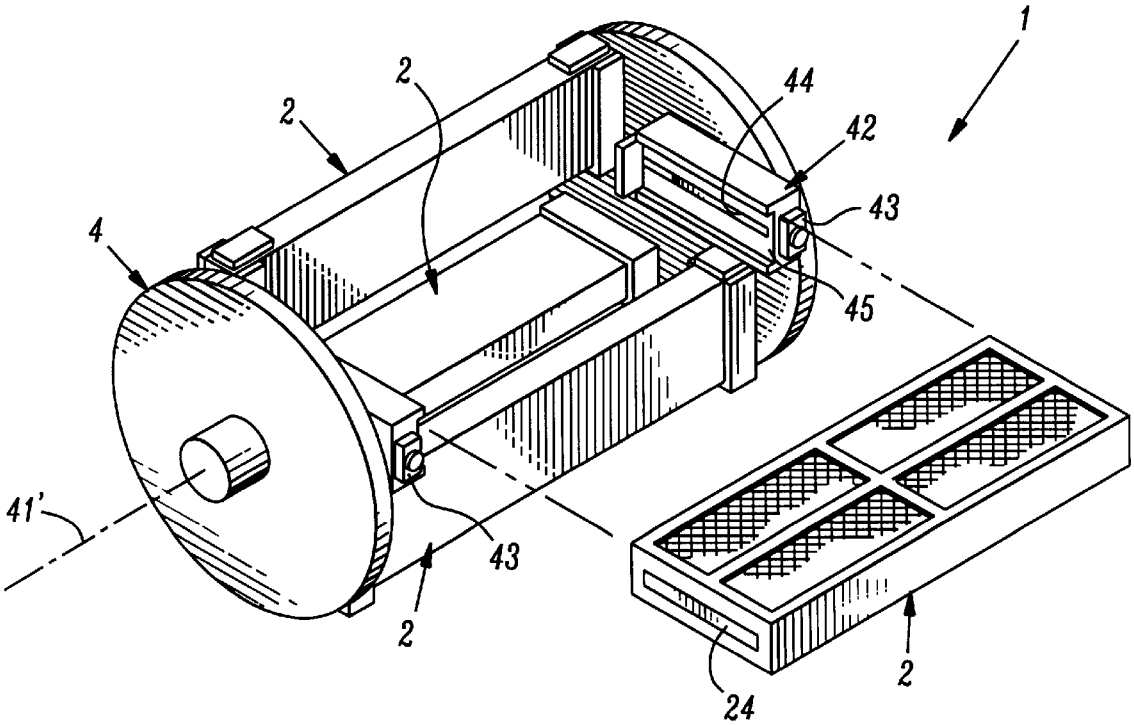
FIG. 4 is a partially exploded perspective view of an electroplating apparatus according to the present invention.
Figure 5:
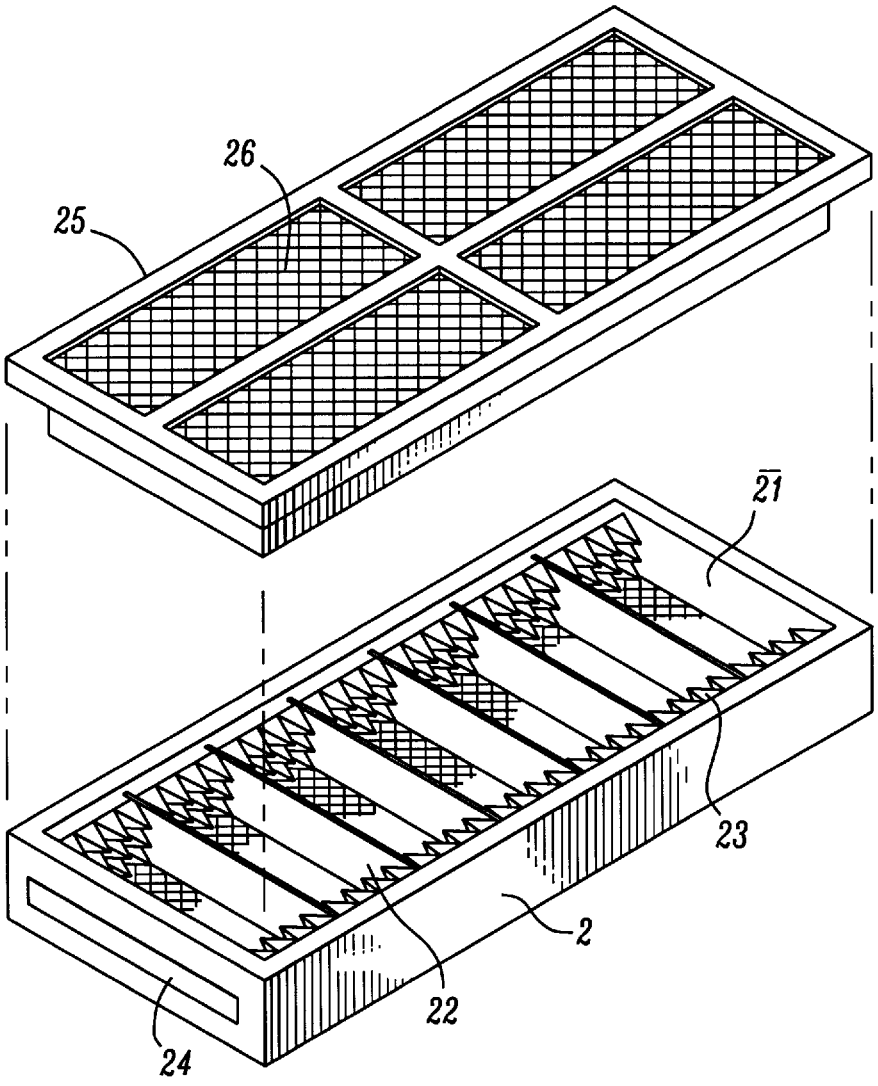
FIG. 5 is an exploded perspective view of a container for electronic parts.
Figure 6:
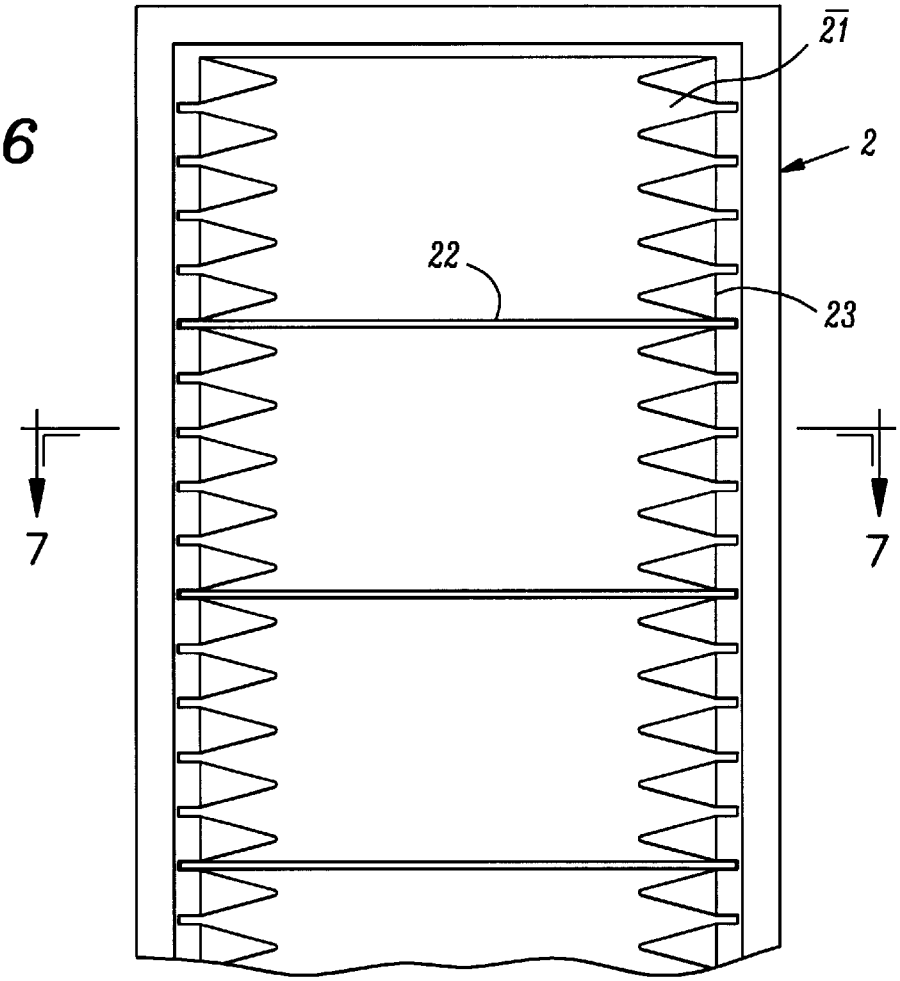
FIG. 6 is a fragmentary top view of the container shown in FIG. 5.

Referring to FIGS. 4–6, an apparatus 1 according to the present invention comprises a rotatable cage 4 including a metal shaft 41 for mounting the cage in an electroplating tank and for rotating the tank, and a plurality of electronic part containers 2. The rotatable cage 4 is provided with a plurality of connecting seats 42 which are substantially tangent to an axis 41' of rotation of the cage 4. Containers 2 are received within the cage 4 by insertion into the connecting seats 42. Each of the connecting seats 42 comprises a guiding slot 45 for guiding and receiving the respective electronic part container 2 therein and a knob 43 for fixing the container 2 in the guiding slot 45. After the connection of the containers 2 with the guiding slots 45, the containers 2 are arranged tangentially to the shaft 41. The connecting seats 42 are provided with an electrically-conducting copper piece 44 which contacts the metal shaft 41 as well as electrically-conducting copper pieces 24 on two opposite ends of the container 2 to form a current path. During an electroplating process, the cage 4 can be disposed within a known electroplating tank, such as shown in FIG. 1, for being both rotated and moved about within the tank using known means. The shaft 41 is connected, for example, to the actuating rod F of the known tank, and the shaft 41 is further connected to a cathode electrode of the plating system.

As shown in FIG. 5, the container 2 takes the form of a thin and rectangular box. The thin box 2 is provided with a plurality of baffle plates 22 which are evenly spaced to define a plurality of compartments 21. Thorns are provided on the side walls of each compartment 21 so as to form thorny walls 23 made of electrically-conducting material. The thorny walls 23 are connected to the electrically-conducting copper pieces 24 on the two ends of the container 2 and provide a cathode electrode within the container. The container 2 has an enclosing cap 25 including a water-permeable screen 26. The bottom of the container 2 is also water-permeable. The electrolyte in the plating tank A (FIG. 1) thus readily circulates through the containers 2.

Figure 7:
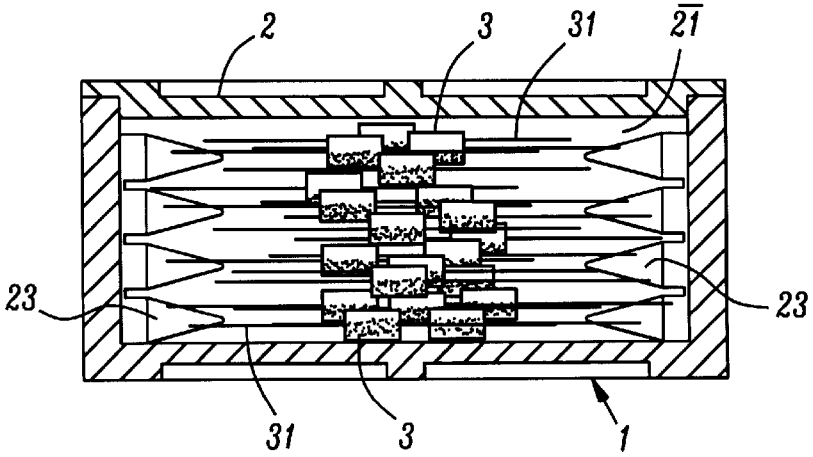
FIG. 7 is a sectional view of the container taken along the line 7—7 of FIG. 6 and showing electronic parts in the container.

As shown in FIG. 7, owing to the configuration of the various compartments 21, the parts, once properly loaded into the compartments, tend to remain in parallel orientation. Also, the orientation of each electronic part 3 is perpendicular to the thorny walls so that the lead wires of the parts are disposed adjacent to and can readily contact with the thorny walls 23.

Summing up the above, the electroplating apparatus of the present invention is able to achieve the following advantages:

1. The probability of lead wire bending is greatly reduced. Since the orientations of electronic parts are the same, the lead wires are securely kept straight.
2. The coating on the surface of the electronic art is more uniform. During electroplating, current through the parts is well-distributed, resulting in a more even and higher current density to the electronic parts, especially to the L.C.D. zones thereof. Furthermore, the coating thickness of H.C.D. zone produced by the conventional method is reduced by the design of the thorny walls so as to achieve a more even coating on the entire lead wires.
3. The orientations of the thin boxes are such as to enhance circulation of the electrolyte thorough the compartments. This contributes to obtaining thicker and more uniform platings.

To demonstrate the quality of electronic parts, an experiment was performed with the same parameters as previously described except that the quantity of electronic parts is 4K per barrel. The following is the result:

| | Plating Thickness Characteristics | Alloy Proportions |
|---|---|---|
| H.C.D. | Average: 450$\mu$ inches | 88.6% |
| | STD. Dev: 275$\mu$ inches | 3.3 |
| | MAX. Value: 1200$\mu$ inches | 93.8% |
| | MIN. Value: 200$\mu$ inches | 80.9% |
| | Range: 980$\mu$ inches | 12.9 |
| L.C.D. | Average: 478$\mu$ inches | 84.2% |
| | STD. Dev: 170$\mu$ inches | 1.1 |
| | MAX. Value: 920$\mu$ inches | 86.4% |
| | MIN. Value: 225$\mu$ inches | 82.2% |
| | Range: 700$\mu$ inches | 4.2 |
| M.C.D. | Average: 405$\mu$ inches | 86.4% |
| | STD. Dev: 150$\mu$ inches | 1.5 |
| | MAX. Value: 740$\mu$ inches | 90.01% |
| | MIN. Value: 150$\mu$ inches | 83.2% |
| | Range: 600$\mu$ inches | 6.8 |

As indicated by the above data, the present invention makes the thickness of the L.C.D. zone and that of the H.C.D. almost equal. Therefore, the quality of the electronic parts is improved.

The thorny walls 23 shown in FIGS. 5–7 comprise a plurality of individual, spaced apart thorns, each thorn being in the shape of a pyramid. The spaced apart thorns on each wall are aligned in rows and columns.

In the embodiment shown in FIG. 7, the lengths of the various parts 3, from lead end to lead end, are less than the distance between the thorny walls at opposite ends of the container 2, hence the parts can be readily loaded into the container without interference by the thorns.

During electroplating, including various rotating and translational movements of the cage 4 (FIG. 4) and the containers 2 therein, the parts 3 move within the containers but, owing to the relatively shallow depth of the containers and the thorny walls 23, the parts retain their parallel orientations. Even with such parallel orientation, the parts tend to clump together where the parts enlarged bodies 3 contact one another on a random basis and, as shown in FIG. 7, the leads 31 of the various parts extend varying distances towards the left and right hand sides of the container. However, because of the tapers of the thorns and the spacings therebetween, the lead ends tend to more freely inwardly between the thorns and along the thorn surfaces. Accordingly, in spite of the variable left to right spacing of the leads, most of the parts have one lead contacting one thorn (cathode) surface at any given time. Thus, efficient and uniform plating occurs.

The thorns thus function to keep the various leads in parallel, non-entangling relationships while providing direct contact of each part with the cathode for causing electroplating of the part leads. Significantly, however, at any given time, only one lead of each part contacts a thorn surface. Because the two leads of each part are electrically separated by the parts body 3, only the one lead actually touching a thorn is electroplated. The other lead is not in contact with the cathode and, during electroplating of the one lead, the portion of the one lead most remote from the thorn is the lead portion immediately adjacent to the parts body 3 and identified in FIG. 3 as the L.C.D. zone.

Figure 3:
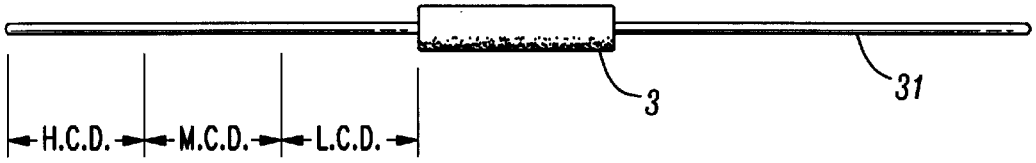
FIG. 3 is a side view of an electronic part.

As previously explained, the rate of plating is greatest at the points most remote from the cathode, hence, on parts plated in the FIG. 7 apparatus, the H.C.D. and L.C.D. zones identified in FIG. 3 (resulting from plating in the prior art apparatus) tend to become reversed. In any event, as previously described, more satisfactory plating results, particularly on the lead zones immediately adjacent to the parts body 3.

Other thorny wall arrangements are possible. Basically, the thorny wall structure is a cathode having a relief or corrugated-like surface.

The thorns (or "teeth") can comprise cones or even round cylinders. Tapered side walls, however, are generally preferred.

Also, although less preferred, the thorns need not be spaced apart both vertically and horizontally. For example, the thorny structure can comprise ridges which extend continuously from top to bottom (or side to side) of each compartment. Adjacent ridges are spaced apart along the width (or the height) of the compartments, and the ridges have sloped walls meeting at a ridge apex.

A still further arrangement for each "thorny" structure comprises a generally flat metal plate including a plurality of spaced apart cavities therein, e.g., dish-shaped or conical cavities or the like.

Basically, the "thorny" structure provides a means for greatly increasing the surface area of the cathode electrode for allowing more extensive and simultaneous direct contacting of a large proportion of the parts with the cathode at any moment. Also, the "thorny" structure serves to maintain the orientation of the parts, for avoiding entanglements thereof, while still allowing relatively free movements of the parts within the circulating electrolyte. By avoiding the formation of chains of parts, variable plating along the length of the leads of individual parts is reduced.

What is claimed is:

1. An electroplating apparatus comprising a rotatable cage having a plurality of connecting seats, each of said connecting seats being tangent to an axis of rotation of said cage and having an electrically-conducting member provided thereon, and a plurality of containers, each of said containers having an electrically-conducting piece provided on each of two ends thereof for contacting said electrically-conducting member of said rotating cage when each of said containers is respectively received in said connecting seats.

2. An electroplating apparatus comprising a thin box for receiving parts to be electroplated, said box having two ends, each of which is provided with an electrically-conducting member, said box including a plurality of spaced apart baffle plates sub-dividing said box into a plurality of compartments, each of said compartments having two side walls each provided with a plurality of electrically-conducting thorns forming an electrically-conducting thorny wall, and each of said thorny walls being in contact with a respective electrically-conducting member.

3. An apparatus according to claim 2 including a plurality of said boxes and a rotating cage having a plurality of guiding slots each for receiving one of said boxes, each of said guiding slots being provided with an electrically-conducting piece for contacting the electrically-conductive member of a box received within each said guiding slot.

4. An apparatus according to claim 2, wherein each thorn of said thorny walls is in the shape of a pyramid, and said thorns of each wall are spaced apart from one another.

5. An electroplating apparatus comprising a first container having a space therein for receipt of parts to be electroplated, said container having two spaced apart electrically conductive side walls disposed at opposite ends of said space, each of said walls having a plurality of protuberances electrically connected to each said wall said protuberances extending into said space for contact by parts within said space, and means for applying an electrical potential to said protuberances.

6. An apparatus according to claim 5 wherein said protuberances are spaced apart from one another over surface areas of said walls.

7. An apparatus according to claim 6 wherein said space has an elongated rectangular configuration defined by: said side walls, spaced apart end walls interconnecting said side walls, and spaced apart top and bottom walls; the length of said space being greater than the width and thickness of said space, and wherein said length is the distance between said side walls, said width is the distance between said end walls, and said thickness is the distance between said top and bottom walls.

8. An apparatus according to claim 5 wherein said container is configured for maintaining elongated parts within said space in generally parallel orientation with respect to one another and perpendicular to said walls, the lengths of said parts along the axis of elongation thereof being less than the distance between said walls.

9. An apparatus according to claim 5 comprising a thin box having two end walls each of which is provided with a respective electrically conductive member, said box including a plurality of spaced apart baffle plates sub-dividing said box into said first container and a substantially identical second container including a plurality of protuberances on side walls of said second container, and said protuberances on corresponding side walls of said first and second containers being electrically connected to respective ones of said conductive members.

10. An apparatus according to claim 5 wherein said container includes two end walls each joining together said side walls.

11. An electroplating apparatus comprising a first container having a space therein for receipt of parts to be electroplated, said container having two spaced apart side walls disposed at opposite ends of said space, each of said walls mounting a respective plurality of protuberances extending into said space and in directions towards the other of said walls for contact by parts within said space, and means for applying an electrical potential to said protuberances.

12. An apparatus according to claim 11 wherein said side walls are electrically conductive, said protuberances are electrically connected to respective said walls, and said walls include means for connecting to a source of electrical potential for applying said electrical potential to said protuberances.

13. An apparatus according to claim 11 wherein said container includes two end walls each joining together said side walls.

14. An apparatus according to claim 11 wherein said container is configured for maintaining elongated parts disposed within said space in generally parallel orientation with respect to one another and generally perpendicular to said side walls, and the minimum spacing between protuberances extending towards one another from respective said side walls is greater than the lengths of said parts disposed within said space.

15. In an electroplating apparatus comprising a container having porous walls for retaining parts to be electroplated within a liquid plating bath, means for moving said container for causing movements of parts within said container relative to one another and relative to said bath, and electrodes for contacting respective portions of the parts for causing electroplating thereof, the improvement comprising two sets of spaced apart electrodes for contacting two respective portions of said parts, each of said electrode sets comprising a plurality of protuberances extending into said container for contacting one of said two respective portions of said parts, and means for applying an electrical potential to said protuberances.

16. An apparatus according to claim 15 including two spaced apart walls within said container between which said parts are retained, said sets of protuberances being mounted on respective said walls and extending inwardly of said container towards the parts contained therein.

17. An apparatus according to claim 16 wherein inwardly extending ends of the protuberances of one of said sets is spaced apart within said container a first distance from inwardly extending ends of the protuberances of the other of said sets, and said first distance being greater than the lengths of parts retained within said container for preventing direct contacting of said parts simultaneously with protuberances from both of said sets.

* * * * *